United States Patent [19]

Joselevich

[11] 4,165,576

[45] Aug. 28, 1979

[54] ADVERTISING OR DECORATIVE SIGN FOR REPRESENTING IMAGES

[76] Inventor: Eduardo J. Joselevich, Av. Libertador 270, Buenos Aires, Argentina, 1001

[21] Appl. No.: 858,961

[22] Filed: Dec. 9, 1977

[30] Foreign Application Priority Data

Dec. 21, 1976 [AR] Argentina ..... 265949

[51] Int. Cl.[2] ..... G09F 7/08; G09F 7/14

[52] U.S. Cl. ..... 40/452; 40/583; 40/605; 40/620

[58] Field of Search ..... 40/452, 574, 605, 620, 40/582, 447, 583, 579, 618, 624

[56] References Cited

U.S. PATENT DOCUMENTS

| | | | |
|---|---|---|---|
| 1,410,194 | 3/1922 | Kolk | 40/452 |
| 1,609,989 | 12/1926 | Chubb | 40/452 |
| 3,291,975 | 12/1966 | McCullough et al. | 40/574 |
| 3,362,093 | 1/1968 | Joselevich | 40/605 X |
| 3,451,681 | 6/1969 | Rossetti | 40/452 X |

*Primary Examiner*—John F. Pitrelli

[57] ABSTRACT

The invention relates to an advertizing or decorative sign for representing images, formed by a base member onto which plate-like members are removably fittable. The plate-like members have different shapes so that by suitably combining them with the base member zones of different degrees of transparency are achieved, which enables to compose an image.

7 Claims, 6 Drawing Figures

ADVERTISING OR DECORATIVE SIGN FOR REPRESENTING IMAGES

BACKGROUND OF THE INVENTION

1. Field of the Invention

The present invention relates to an advertising or decorative sign for representing images, and more particularly it refers to a device or kit which, by means of the members constituting said kit enables to compose in a simple manner such images, and the same members may be used to compose different images.

2. Description of the Prior Art

In my U.S. Pat. No. 3.362.093 granted on Jan. 9th., 1968 an advertising or decorative sign for representing images has been proposed comprising a plurality of hollow plate supporting frames, each hollow plate supporting frame comprising parallelly spaced apart girders, each having a main body portion and a head portion, said head portion having a poligonally-shaped cross section, and a plurality of parallelly spaced linking posts, said posts having polygonally-shaped cross sections and are fitted in said head portions of said girders to define therewith cells, said girders and linking posts having end portions, end members having an outer flat surface and an inner complementary surface to said head portions surrounding said end portions of said linking posts and girders, said outer flat surfaces of said end members of adjacent hollow plate supporting frame being in facing relationship, whereby said plurality of hollow plate supporting frames define a surface of the sign, a plurality of plate-like plastic members mountable over said cells and defining a substantially continuous front surface on said frame, each plate-like member having a resilient skirt for mounting said plate-like member over said cells, said plate-like members comprising a first series of translucid members, a second series of opaque members, a third series of translucid members having an opening and a fourth series of opaque members having an opening, a first type of translucid resilient plastic inserts and a second type of opaque resilient plastic inserts removably mountable on said fourth and third series of members to cover said openings, hook members connected to said end members and projecting out of said hollow plate supporting frames in a direction opposite to said head portions, light reflector casing have light emitting means and complementary hook supporting members for receiving said hook members, said light emitting means being substantially transversely arranged with regard to said main body portions of said girders, said light emitting means being adapted to project light beams onto said plate-like plastic members.

SUMMARY OF THE INVENTION

Although these advertising signs which are used for large signs are satisfactory, the structural principle of these signs cannot be used for relatively smaller display units to be preferably used for indoor advertising because the above referred to cells must have a certain minimum size of at least 4 square centimeters so that it becomes necessary, in order to create images, to use relatively large total surfaces and to regard the signs at a substantial distance in order to achieve a true subliminal perception. Thus, for instance an airplane image could be created for a large sign to be in front of an airline building, but such system could not be adapted for representing the same image on a small display to be located within the building or travel agency.

In order to compose images on signs of smaller surfaces, such as 20 cm×10 cm, the present invention has been conceived which could be defined as consisting of an advertising or decorative sign for representing images of small size, comprising at least one base member representing a first type of module which is divided into rows and columns forming resilient basic units with memory, each basic unit having a central embossed and tapered end with a front fact and a surrounding sloping zone oriented according to a plane which is approximately parallel to the plane containing said front face, said sloping zone having a perimetral portion, the perimetral portion of said sloping zone ending in a first channel, and a plurality of cover plates capable of being press-fitted and covering at least partially said basic units, said plates defining second types of modules which are submultiples of said first type of module, said cover plates being likewise resilient and having memory and having approximately the same shape and arrangement as said basic unit, said cover plates comprising a first series having basic units with substantially identical central embossed and tapered zones each with a front face member and a surrounding sloping zone including a perimetral portion which ends at least into a partial channel capable of entering and becoming linked to the first channel, a second series having basic units each with a central zone defining an opening and a surrounding sloped zone, having a perimetral portion which likewise ends into a channel also capable of entering and becoming linked to the first channel, and a third series having only caps with a front face, each cap having a substantial identical shape to the embossed central portion of each basis unit.

From the foregoing, it is apparent that the new display may consist of one or several base members each of which is an integral member whereby it will only be necessary to fit on certain zones thereof additional or cover members which may be opaque or colored in order to compose the desired image.

Furthermore, it is possible to cover predetermined zones of the base member by means of a single composite cover member. Thus, the process of composing the image is considerably less time consuming than in the case of the sign of my prior patent.

The different members constituting the signs may be provided by way of kit so that the base member may be used for forming signs with different images.

DESCRIPTION OF THE PREFERRED EMBODIMENT

Figures 1, 2, 3, 7:
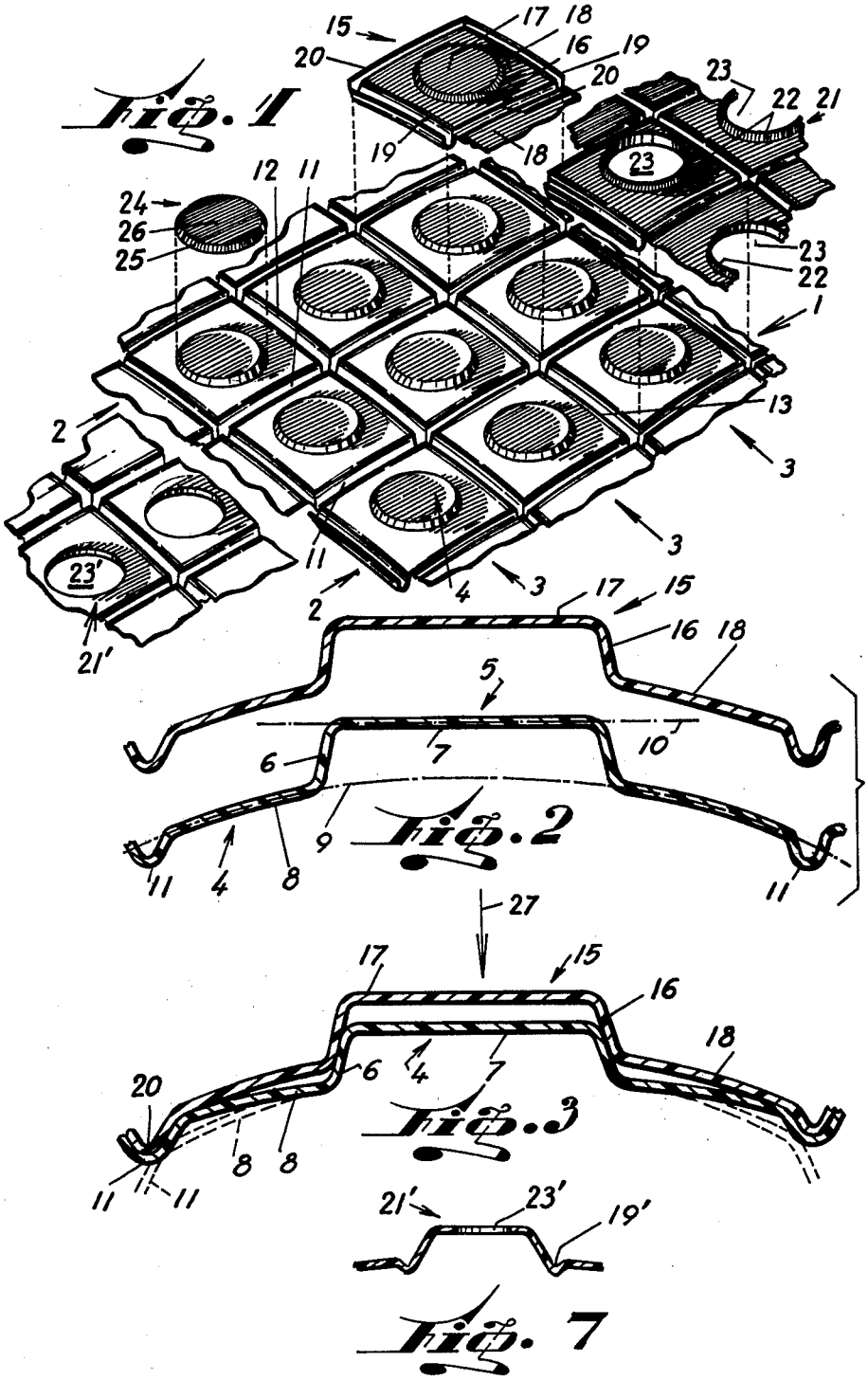
FIG. 1 is an exploded perspective view of an advertising or decorative sign for representing images of small size showing part of a base member and the different types of cover members which enable one to compose an image in accordance with the present invention.
FIG. 2 is a detail in longitudinal section of part of a base member and a cover member in the position prior to the assembly.
FIG. 3 is a longitudinal section similar to FIG. 2, but showing the two members in assembled position.
FIG. 7 is a detail in longitudinal section of an alternative structure usable in the members shown in FIG. 3.

As may be seen in FIG. 1, the advertising or decorative sign for composing images in a small display, comprises at least one base member 1 which is divided into rows 2 and columns 3 forming basic units 4 which in the embodiment shown are of substantially square shape.

As will be better understood further on, the basic units need not be square-like, but should preferably be of regular shape.

The base member is preferably a molded member of flexible material, having a memory. Such material may be plastics, preferably incombustible or metal, such as aluminum foil. Each basic unit 4 comprises (see FIG. 2) an embossed central zone 5 defining a truncated cone, comprising a side wall member 6 and a front face member 7 defining the smaller base of the truncated cone. The embossed central zone 5 is surrounded by a sloping zone 8 substantially defining a slightly arcuate first plane 9 approximately parallel to a second plane 10 containing said front face member 7. Actually, plane 9 is a curved plane defined by a large radius, so that the concept exposed that the planes 9 and 10 are approximately parallel is only applicable for the plane 9 in the zone limited by the side wall member 6. Plane 9 becomes more parallel to plane 10 when the sign is assembled, as will be understood later on.

The perimetral zone of each sloping zone 8 ends in channel members 11, defining the rows 2 and in channel members 12 defining the columns 3.

If the perimeter of the sloping zone 8 is of a poligonal shape different from a square, then the number of channel members would increase correspondingly up to theoretically reaching the limit where the perimetral zone of each basic unit is annular and in which event there would be only one annular channel, for instance, a circular channel for each basic unit.

It will be understood by those skilled in the art, that the base member 1 is to be molded in a single mold to define a plurality of basic units 4.

Figure 4:
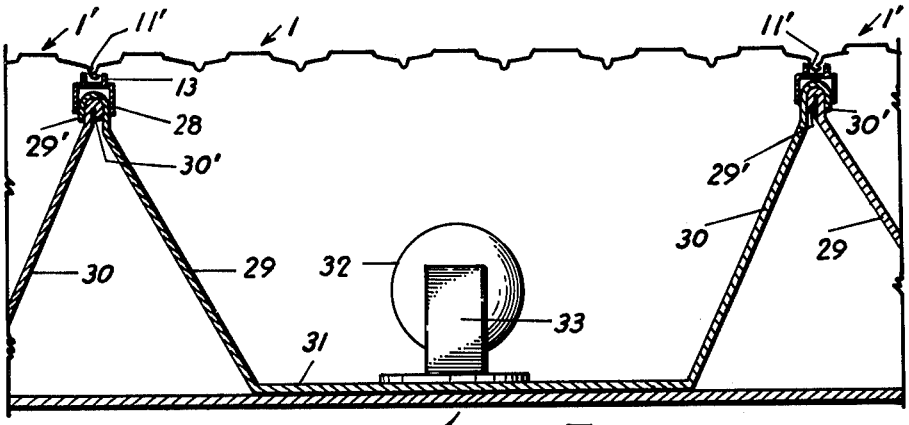
FIG. 4 is a section through an advertising or decorative sign in accordance with the present invention showing only base members and part of the light emitting source.
Figure 5:
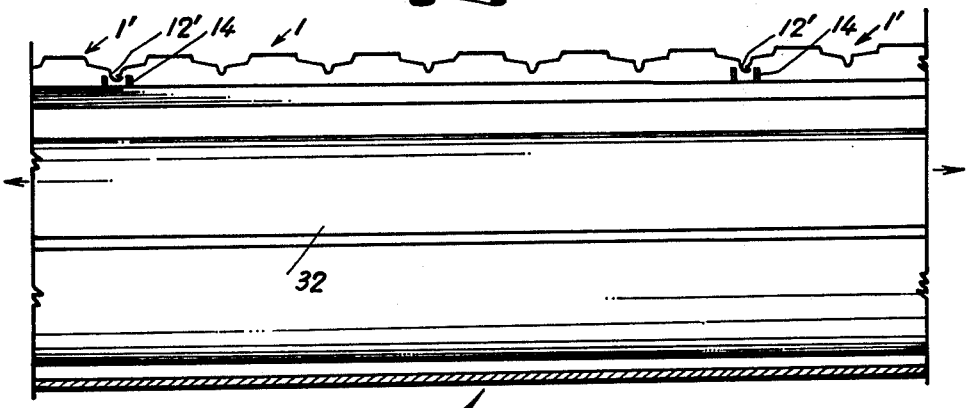
FIG. 5 is a sectional view rotated at 90° with regard to the one shown in FIG. 4.

If a sign of larger size is desired, than the sign provided by one base member 1, then it would only be necessary, such as shown in FIGS. 4 and 5, to locate the half channel members or end channel members 11' and 12' of adjacent base units 1' in "U" shape receiving channels 13 and 14, where the legs or side walls of said "U" define a space in which adjacent end channel members 11' and 12' are to be placed to thus obtain the necessary fitting pressure on the end channel members to achieve an assembly of several base members.

The sign of the present invention further comprises a plurality of cover members which in principle are molded in a similar mold to the one used for producing the base members. These cover members formed by a plurality of molded units can then be cut in the zone of the channel members to form plates where the number of the basic units is smaller than the number of the basic units of the base member; it being possible to reach the case where the cover plate consists of a single basic unit or of as many basic units as the base member has.

Before describing in detail the cover members or plates, it is to be pointed out that the basic unit 4 of the base member 1 may be considered as being a module.

As to the cover plates, these consist of four different types of modules.

More particularly, as may be appreciated from FIG. 1, the first type of module or cover plate 15 is of a substantially identical structure and arrangement as the basic unit 4. In fact, it comprises an embossed zone defined by a frustoconical side wall member 16 and a front face member 17 as well as a surrounding sloping zone 18 and the channel members 19 and 20.

The second type of module 21 of the cover plates differs from the first type 15 in that although it has an embossed central zone formed by a lateral side wall member 22, it has no front face member so that the side wall member 22 circumscribes an opening 23.

The third type of module 21' of the cover plate differs from the second type in that it has no side wall member 22 surrounding the opening 23' which is larger than the opening 23.

Finally the fourth type of module 24 consists of a member being equivalent to what has been so far called "embossed zone" and which actually is a cap. In fact, the cap of this fourth type of module 24 comprises a lateral wall member 25 and a front face member 26, but has no sloping zone nor channel members.

Since the four types of modules 15, 21, 21' and 24 are produced in relatively large quantities, in order to be able to compose different images, one may state that there are series of modules 15, 21, 21' and 24, respectively.

Referring now to FIGS. 2 and 3, it will now be described how the different types of cover plates may be linked to the base member.

As already stated, all the different types of members are molded with the same type of molds and therefore the shape of the base member, as well as of the modules corresponding to the cover plates are substantially identical and in any event they are complementary.

It is to be recalled that these members are molded of a resilient material having a memory. If a basis unit 4 of the base member 1 is to be covered by a cover plate so that the zone of such a basic unit 4 becomes opaque or in other words will not allow the passage of light, the module 15 is pressure fit on the module 4, such as shown in FIG. 3 and more particularly the projecting portion defined by the lateral wall member 16 and the front face member 17 is press-fitted onto the lateral wall member 6 and the front face member 7. Since both lateral wall members 6 and 16 are frustoconical and resilient (of substantially the same shape), upon applying a pressure in the direction indicated by arrow 27, the side wall member 16 will exert a radial pressure towards the center onto the side wall member 6 of the other element and thereby the sloping zone 8 which originally had the shape shown in dotted lines (FIG. 4) will become flattened, such as shown in full lines and exert an upward pressure onto the sloping portion 18 and the channel members 11 and 20 will establish a strong linkage, whereby the basic unit 4 will become fully covered by module 15 and both are intimately linked together.

It is also possible to provide all the modules with a channel 19' (see FIG. 7) which surrounds the embossed portion and thereby increases the friction coefficient between the press-fitted members.

Figure 6:
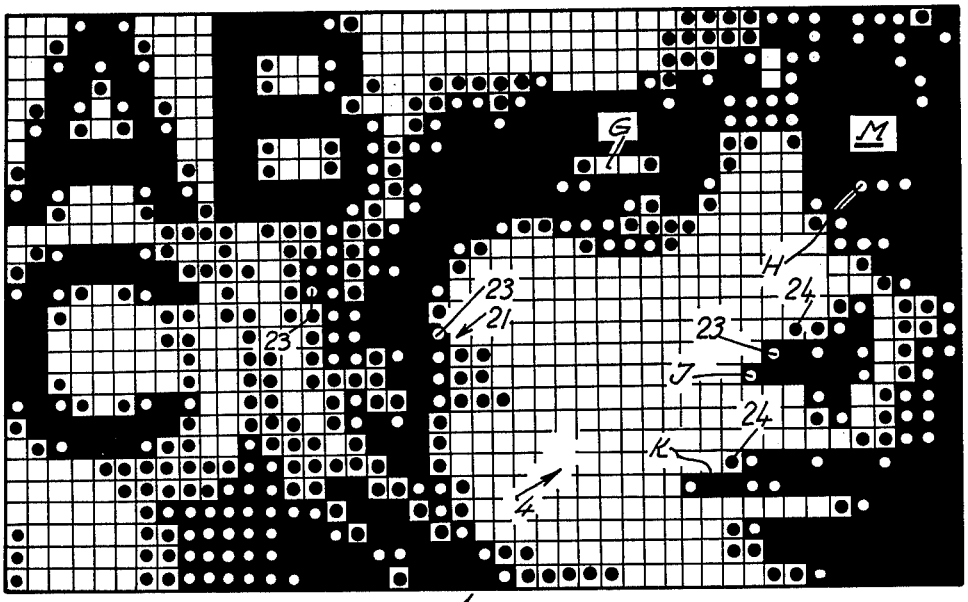
FIG. 6 is a lay-out of a portion of a sign showing an image as formed by the members of the present invention.

Referring now to FIG. 6, it may be appreciated that here a lay-out is shown where a face of a woman is represented having the eyes G and H, the nose J, and the mouth K. The central zone L which approximately corresponds to a cheek, is defined by the base member, that is to say by a plurality of basic units 4 without cover plates and the zone corresponding to the hair M is a zone covered by cover plates 15 corresponding to the first and second type of modules.

The module 21 is identified in a portion of the lay-out and allows the passage of light through the opening 23 but, on the other hand, defines an opaque sloping zone and finally the other type of module, that is the cap 24, produces the effect of a dark spot in the center of a module.

With regard to the second type of module 21, the latter is press-fitted in a similar way on the base member as the module 15.

As to the fourth type of module or cap 24, the latter is simply press-fitted onto the projecting portion 6, 7 of the pertinent basic unit 4. The side wall 25 of the cap, upon having substantially the same shape as the side wall member 6 of the basic unit 4, will obviously exert a radial pressure towards the center and since both members have memory, there will be no problem in press-fitting and linking the two elements together.

Sometimes, certain color effects may have to be achieved in which event the third module 21' of a different color and the fourth module or cap 24 of another color can be used as a combination.

On the left hand side of FIG. 6, three types of letters, namely A, B and C are shown, and the way in which the images of these letters are composed.

Referring now to FIGS. 4 and 5, the beams 13 are actually composite beam members formed by the beam members 13 and 28 so as to define a shape similar to an H whereby the beam 28 is an inverted "U" shaped member preferably of larger size than the beam 13. These beams 28 define retaining members for two adjacent reflectors; each reflector having a trapezoidal shape defined by side wall members 29 which diverge from a base portion 31 and end in pertinent hooks 29' and 30' which overlap and are press-fitted into the inverted beam 28 to thus be able to assemble reflectors. Each reflector has a light source, such as a tubular member 32 mounted on supports 33 (only one being visible) and which emit light beams towards the base member or members.

It is obvious that if the base member 1 and the cover plates are molded of an incombustible plastic material, they may have different colours, so that upon being press-fitted together two colors may generate a third color and thereby certain particular effects are achieved. It is also to be stated that within the concept of the present invention it is possible that several cover plates of different colors are mounted one on top of the other one as basic unit 4 in order to achieve a larger variety of colours.

It is also within the concept of the present invention that the decorative or advertising sign may consist of the members as described, but used in a reverse manner, so that when the concave sides of the sloping zones are toward the observer, the embossed zones will appear as recesses.

It is also to be pointed out that if on small signs, texts have to be provided, that special modules 24 may be used wherein instead of having a flat front face member 26 the latter may have embossed letters or painted letters and/or numbers thereon.

Although one embodiment of the invention has been illustrated and described in detail, it is to be expressly understood that the invention is not limited thereto. Various changes can be made in the design and arrangement of the parts without departing from the spirit and scope of the invention as the same will now be understood by those skilled in the art.

I claim:

1. An advertising or decorative sign for representing images of small size, comprising at least one base member representing a first type of module which is divided into rows and columns forming a plurality of resilient basic units having elastic memory, each basic unit having a central embossed and tapered end with a front face and a surrounding sloping zone oriented according to a plane which is approximately parallel to the plane containing said front face, said sloping zone having a perimetral portion, the perimetral portion of said sloping zone ending in a first channel, and a plurality of cover plates capable of being press-fitted and at least partially covering said basic units, said plates defining second types of modules which are submultiples of said first type of module, said cover plates being likewise resilient and having elastic memory and having approximately the same shape and arrangement as said basic unit, said cover plates comprising a first series having basic units with substantially identical central embossed and tapered zones each with a front face member and a surrounding sloping zone including a perimetral portion which ends at least into a partial channel capable of entering and becoming linked to the first channel, a second series having basic units each with a central zone defining an opening and a surrounding sloped zone, having a perimetral portion which likewise ends into a channel also capable of entering and becoming linked to the first channel, a third series having only caps with a front face, each cap having a substantial identical shape to the embossed central portion of each basic unit, whereby a combination of differing ones of said series of cover plates combine with said base member to provide a display having different degrees of transparency, and support means for supporting said base member by cooperating with the perimetral channels thereof.

2. The advertising or decorative sign for representing images of small size of claim 1 which further comprises a fourth series of modules having basic units with a central embossed and tapered zone but without a front face member and a surrounding sloping zone having a perimetral portion which ends likewise into a partial channel also capable of entering and becoming linked to the first channel.

3. The advertising or decorative sign for representing images of small size of claim 2, wherein the four types of modules are square shaped and the embossed zones are frustoconical.

4. The advertising or decorative sign for representing images of small size of claim 3, wherein the central embossed zones are each surrounded by a channel.

5. The advertising or decorative sign for representing images of small size of claim 1, wherein each cap has on its front face an image.

6. The advertising or decorative sign for representing images of small size of claim 1, wherein the channels defining the perimetral portions of the base members are fittable in beams which act as said support means and form a part of a light reflector arrangement located behind the base member.

7. The advertising or decorative sign for representing images of small size of claim 6, wherein each beam has an H shaped cross-section so as to house overlapping hooks of adjacent reflectors and adjacent channel members of two base members into said beam.

* * * * *

UNITED STATES PATENT AND TRADEMARK OFFICE

CERTIFICATE OF CORRECTION

PATENT NO. : 4,165,576

DATED : August 28, 1979

INVENTOR(S) : Eduardo J. Joselevich

It is certified that error appears in the above-identified patent and that said Letters Patent are hereby corrected as shown below:

Title Page [76], in "Eduardo J. Joselevich, Av." please move the "Av." to read -- Eduardo J. Joselevich, Av. Libertador 270, Buenos Aires, Argentina, 1001 --.

[56], after "Primary Examiner - John F. Pitrelli" please enter the attorneys of record, -- Attorney, Agent or Firm - Christie, Parker & Hale --.

[57], in the first line of the Abstract, change "advertizing" to -- advertising --; in line 5 of the Abstract, after the word "member" add -- , --; in line 7 of the Abstract, add the word -- one -- after the word "enables"; after the last line of the Abstract, change "7 Claims, 6 Drawing Figures" to -- 7 Claims, 7 Drawing Figures --.

Column 1, line 10, after the word "enables" add -- one --; line 48, the word "casing" should be -- casings --.

Column 2, line 11, the word "fact" should be -- face --; line 14, the word "perimetral" should be -- perimetrical --; lines 14 and 15, the word "peri-metral" should be -- peri-metrical --; line 27, the word "perimetral" should be -- perimetrical --; line 31, the word "perimetral" should be -- perimetrical --; line 36, the word "basis" should be -- basic --.

Column 3, line 35, the word "perimetral" should be -- perimetrical --; line 41, the word "perimetral" should be -- perimetrical --.

Column 4, line 42, the word "basis" should be -- basic --.

UNITED STATES PATENT AND TRADEMARK OFFICE

CERTIFICATE OF CORRECTION

PATENT NO. : 4,165,576 Page 2 of 2

DATED : August 28, 1979

INVENTOR(S) : Eduardo J. Joselevich

It is certified that error appears in the above-identified patent and that said Letters Patent are hereby corrected as shown below:

Column 5, line 48, the word "colours" should read -- colors --; line 54, the word "colours" should read -- colors --.

Column 6, lines 14 and 15, Claim 1, the word "peri-metral" should be -- peri-metrical --; line 15 the word "perimetral" should be -- perimetrical --; line 26, the word "perimetral" should be -- perimetrical --; line 30, the word "perimetral" should be -- perimetrical --; line 39, the word "perimetral" should be -- perimetrical --.

Column 6, line 45, Claim 2, the word "perimetral" should be -- perimetrical --.

Column 6, line 60, Claim 6, the word "perimetral" should be -- perimetrical --.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*